US007448879B2

(12) United States Patent
Jin

(10) Patent No.: US 7,448,879 B2
(45) Date of Patent: Nov. 11, 2008

(54) ELECTRICAL CONNECTOR

(75) Inventor: Zuofeng Jin, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/882,966

(22) Filed: Aug. 8, 2007

(65) Prior Publication Data

US 2008/0153337 A1 Jun. 26, 2008

(30) Foreign Application Priority Data

Dec. 21, 2006 (CN) ..... 2006 2 0155059 U

(51) Int. Cl.
*H01R 12/00* (2006.01)

(52) U.S. Cl. ..... 439/71; 439/331

(58) Field of Classification Search ..... 439/70–73, 439/331

See application file for complete search history.

(56) References Cited

U.S. PATENT DOCUMENTS 5,221,209 A * 6/1993 D'Amico ..... 439/71
6,319,063 B1 * 11/2001 Huang ..... 439/610
7,241,161 B2 * 7/2007 Mar ..... 439/331

FOREIGN PATENT DOCUMENTS

TW 200410065488.2 6/2006

* cited by examiner

*Primary Examiner*—Truc T Nguyen
(74) *Attorney, Agent, or Firm*—Rosenberg, Klein & Lee

(57) ABSTRACT

An electrical connector that connects a chip module to a printed circuit board is proposed. The electrical connector comprises an insulator and a strengthening member disposed outside of the insulator. The strengthening member contains a sidewall for positioning the insulator and a location member bending and extending out of the sidewall. A plurality of positioning holes matching with a plurality of locking members are disposed on the location member to attach the strengthening member on the printed circuit board. The electrical connector electrically connects between the chip module and the printed circuit board without a bottom base or the lever of a LGA socket by forming a connection between the chip module, the insulator, and the printed circuit board through only the strengthening member. Due to its less complicated structure the present invention lowers production costs and increases the market competitiveness of products that utilize the device.

10 Claims, 3 Drawing Sheets

ELECTRICAL CONNECTOR

BACKGROUND OF THE INVENTION

1. Field of the Invention

The present invention is related to an electrical connector that electrically connects with a chip module.

2. Description of Related Art

As electronic technology has rapidly developed, the electrical connector such as LGA Socket that electrically connects CPUs to printed circuit boards is more commonly used throughout the computer industry to transmit data.

At present, the LGA Socket usually includes an insulator, a metallic strengthening member disposed outside of the insulator, and a pressing sheet and a lever are pivoted on respective opposite sides of the metallic strengthening member. The metallic strengthening member is mounted on a printed circuit board via a plurality of screws to reduce the printed circuit board bending or warping out of sharp, which can avoid solder balls falling off the electric conductive terminals, and increase the reliability of the electric connection.

However, the disadvantages of the electrical connector described above are that there are too many elements and structure is highly complicated, which leads to increase production costs and reduce the market competitiveness of any product that uses such an electrical connector.

Therefore, in view of this, the inventor proposes the present invention to overcome the above problems based on his expert experience and deliberate research.

SUMMARY OF THE INVENTION

The object of the present invention is to provide an electrical connector for simplifying the structure of the device and lowing its associated production costs.

In order to achieve the above object, the present invention provides an electrical connector for a chip module that electrically connects to a printed circuit board. The electrical connector comprises an insulator and a strengthening member disposed out of the insulator. The strengthening member includes a sidewall for positioning the insulator and a location member bent and extended outward from the sidewall. A plurality of positioning holes are disposed on the location member which is accompanied with a plurality of locking members for fixing the strengthening member to the printed circuit board.

Compare to the prior art, the electrical connector of the present invention can electrically connect with the chip module, and the printed circuit board through the strengthening member without the pressing sheet and the lever. The electrical connector, even though has a less complicated structured, can fully perform the functions of a normal LGA socket. As a result, this present invention lowers production costs and increases the market competitiveness of products that utilize the device.

DETAILED DESCRIPTION OF THE PREFERRED EMBODIMENTS

Figure 1:
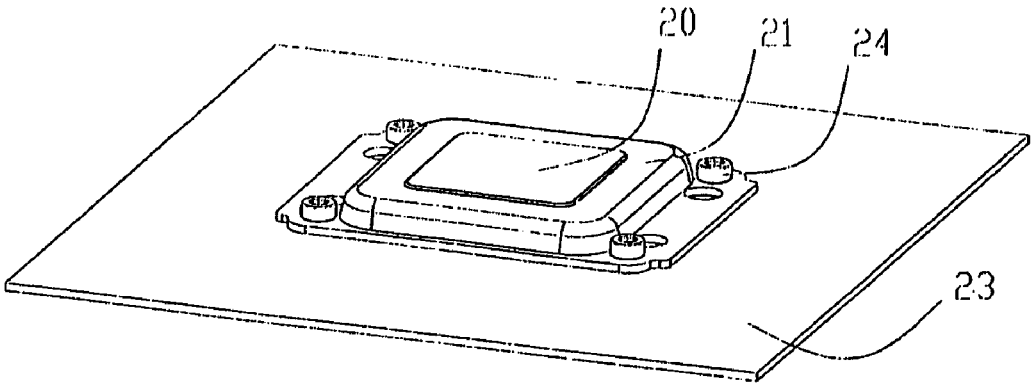
FIG. 1 is an assembled perspective view of an electrical connector in accordance with the present invention with a chip module and a printed circuit board.
Figure 2:
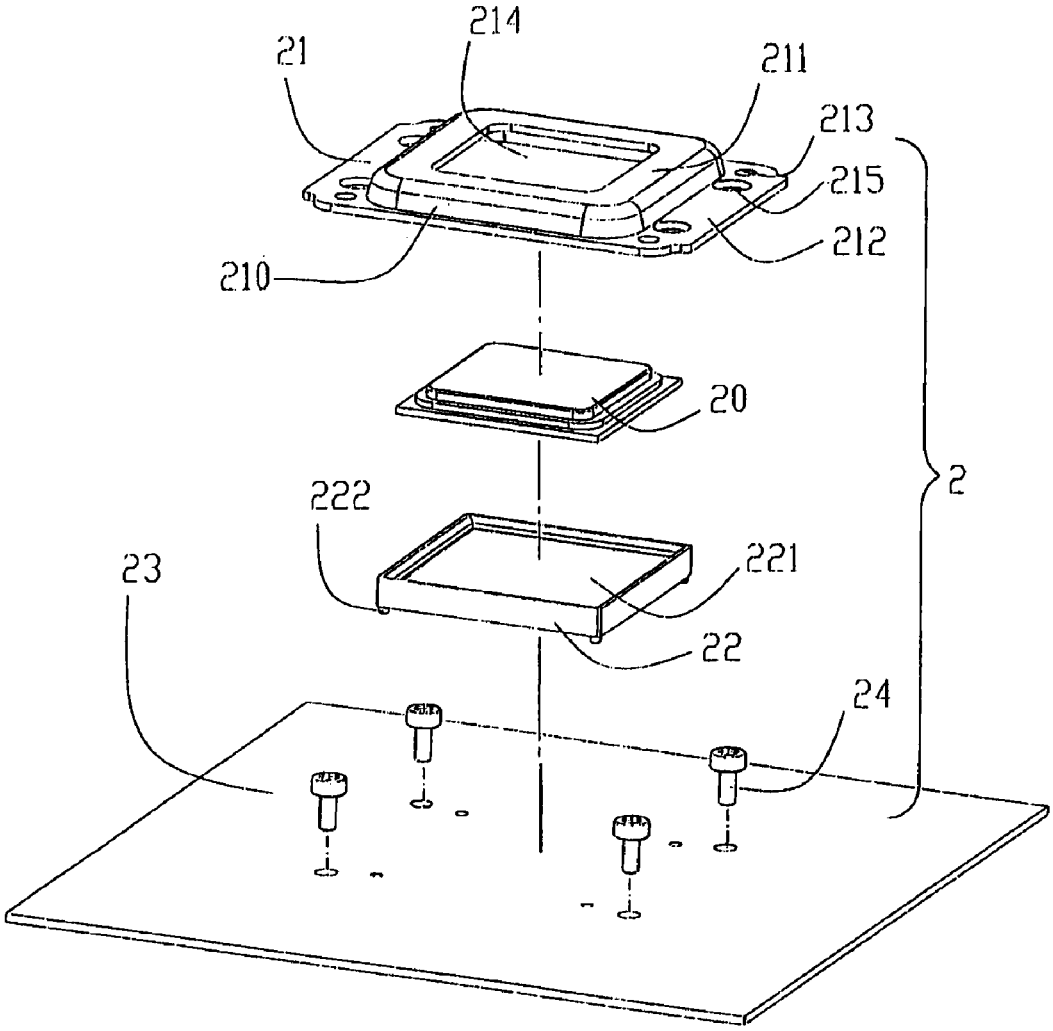
FIG. 2 is an exploded view of the electrical connector as shown in FIG. 1.
Figure 3:
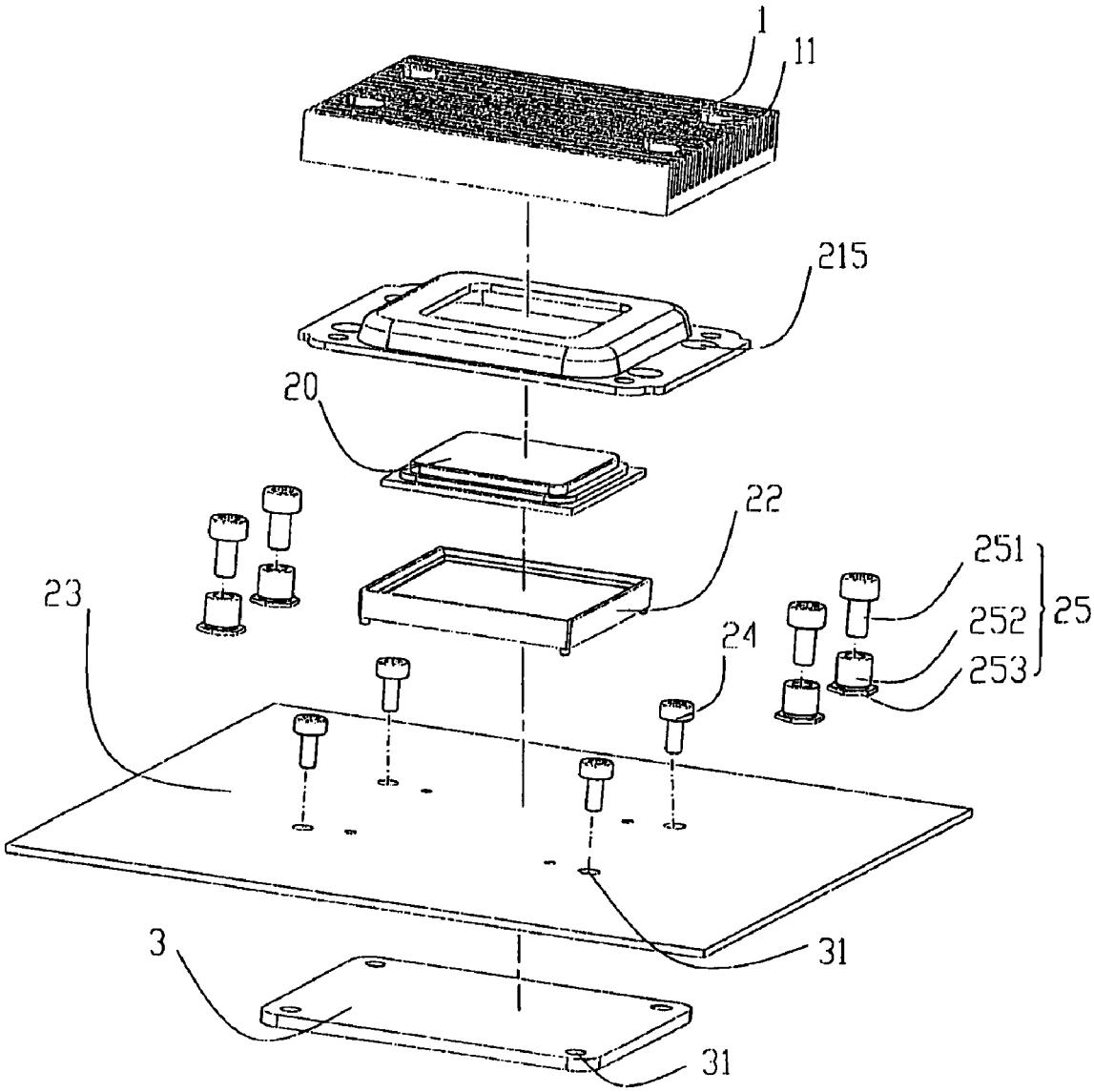
FIG. 3 is an exploded view of the electrical connector as shown in FIG. 1 with a radiator.
Figure 4:
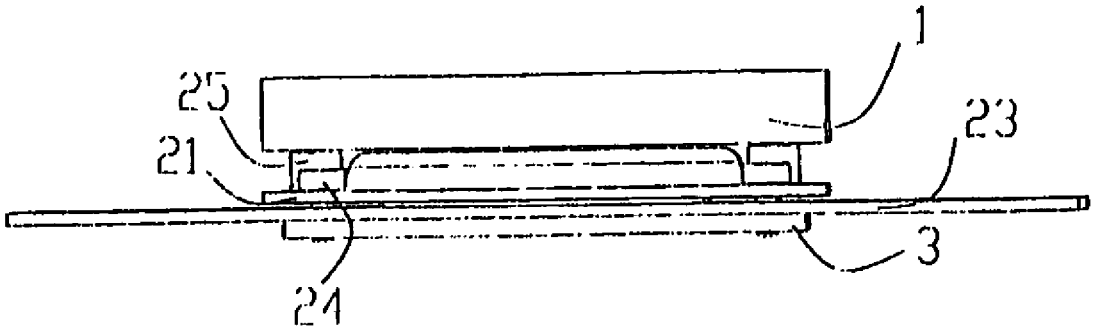
FIG. 4 is an assembled perspective view of the electrical connector as shown in FIG. 1 with a radiator.

Please refer to FIGS. 1 to 4 that illustrate an electrical connector 2, which electrically connects a chip module 20 to a printed circuit board 23. The electrical connector 2 includes an insulator 22 and a strengthening member 21 disposed outside of the insulator 22 for positioning the insulator 22 and pressing the chip module 20. The strengthening member 21 is also disposed on the printed circuit board 23, which increases the strength of the printed circuit board 23 and avoids the printed circuit board 23 from being bent out of shape.

The insulator 22 has a rectangular shape and includes a terminal receiving area 221, which contains a plurality of terminal receiving holes (not shown). The terminal receiving holes are matched with electric conductive terminals (not shown), which connect to the chip module 20. The insulator 22 extends from below and forms four protrusion portions 222. The protrusion portions 222 help to position the insulator 22 to the printed circuit board 23 by connecting with four corresponding resilient holes on the printed circuit board 23.

The strengthening member 21 contains a sidewall 210 for positioning the insulator 22. The sidewall 210 has a frame structure. A location member 212 bends and extends outwardly from the bottom of the sidewall 210. A plurality of positioning holes which match a plurality of locking members are disposed on the location member 212 to attach the strengthening member 21 on the printed circuit board 23. The positioning holes include four fixing holes 213 and four assembly holes 215 respectively. The fixing holes 213 are located around the parameter of the assembly holes 215. The diameter of the fixing holes 213 is smaller than the assembly holes 215. The fixing holes 213 and the assembly holes 215 are disposed symmetrically around the location member 212. A pressing region 211 is bended inward and formed from the top of the sidewall 210 for pressing the chip module 20 downwards. The pressing region 211 has a rectangular shape. An opening 214 is located in the center of the pressing region 211, from which the chip module 20 is slightly exposed out thereof.

The locking members include a plurality of screws 24. A plurality of fitting holes 31 which are matched with the fixing holes 213 on the strengthening member 21 are disposed on the printed circuit board 23 and a back plate 3 that is matched with the electrical connector 2. The screws 24 pass through the fixing holes 213 and the fitting holes 31 to attach the strengthening member 21 and the back plate 3 on the printed circuit board 23 for increasing the rigidity of the printed circuit board 23. The locking members also contain a pair of screw assemblies 25. The screw assembly 25 includes a screw bolt 251, a screw nut 252, and a gasket 253. The gasket 253 is disposed below the screw nut 252. A plurality of through holes 11 corresponding to the assembly hole 215 on the strengthening member 21 are set up on a radiator 1 that is matched with the electrical connector 2. The screw assemblies 25 pass through the through holes 11 and the assembly holes 215 to attach the radiator 1 and the strengthening member 21 on the printed circuit board 23.

In the assembly process the protrusion portions 222 on the insulator 22 of the electrical connector 2 are first inserted into the resilient holes on the printed circuit board 23. Next, the chip module 20 is disposed into the terminal receiving area 221 inside the insulator 22 and the screws 24 pass through the fixing holes 213 of the strengthening member 21 and the fitting holes 31 on the back plate 3. Finally, the screw bolts 251 pass through the through holes 11 of the radiator 1 and the assembly holes 215 of the strengthening member 21 and are matched with the screw nuts 252 on the printed circuit board 23 to attach the radiator 1 on the strengthening member 21. Furthermore, the strengthening member 21 is fixed on the printed circuited board 23.

The electrical connector 2 can electrically connect with the chip module 20 and the printed circuit board 23 through the strengthening member 21. The present invention of an electrical connector 2, even though it has a less complicated structured, can fully perform the functions of a normal LGA socket. As a result, this present invention lowers production costs and increases the market competitiveness of products that utilize the device.

Figure 5:
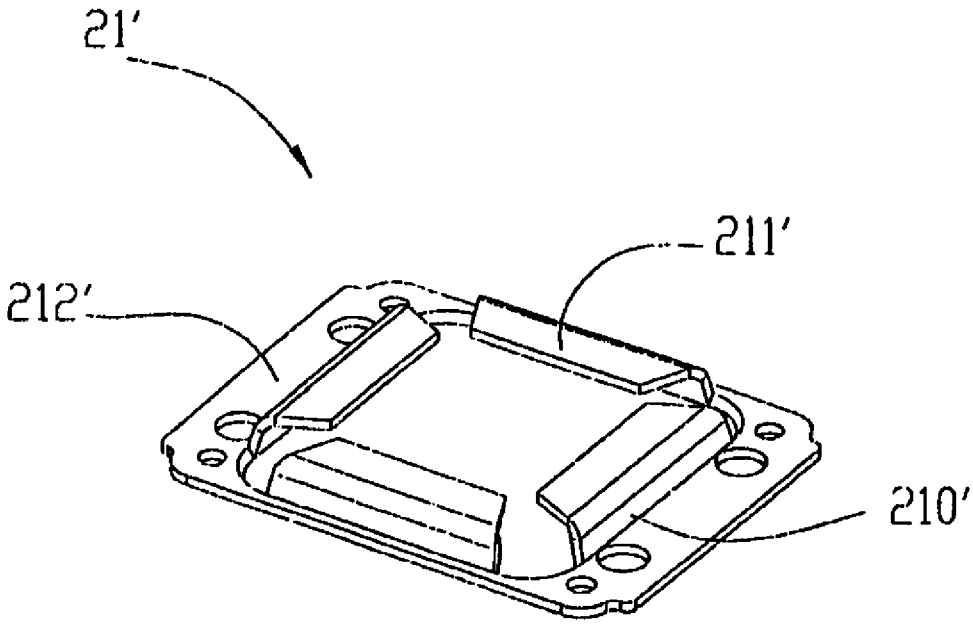
FIG. 5 is a perspective view of another embodiment of a strengthening member according to the present invention.

Please refer to FIG. 5 that illustrates another embodiment of the strengthening member 21'. The differences between the first embodiment and the second embodiment are that a sidewall 210' of a strengthening member 21' includes at least two independent parts (four independent parts are disposed symmetrically as is shown in this embodiment). A location member 212' extending to the outside from the bottom of the sidewall 210' forms a structure with a plate shape that connects the parts together. The top of the sidewall 210' bends to the inside and forms a pressing region 211' with the shape of a wedge for the purpose of pressing down the chip module. This embodiment also meets the objects of the first embodiment.

What is claimed is:

1. An electrical connector for electrically connecting a chip module to a printed circuit board, comprising:

an insulator sandwiched between the printed circuit board and the chip module; and a strengthening member, the strengthening member including:

a pressing region, a location member, and a sidewall extending between said pressing region and said location member, said sidewall and said pressing region defining a receiving cavity for receiving said chip module and insulator therein, said location member bending and extending outwardly and substantially along entire bottom edge of said sidewall externally to said receiving cavity of said strengthening member, said location member having a plurality of positioning holes formed therein in alignment with fitting holes defined on the printed circuit board, wherein, when said location member is secured to the printed circuit board by locking members extending through said positioning holes of said location member and respective said fitting holes of the printed circuit board, said insulator and chip module are pressed down by said pressing region to the printed circuit board.

2. The electrical connector according to claim 1, further comprising a radiator having a plurality of through holes formed therein in alignment with respective assembly holes formed on said location member, and screws extending through said through holes and said respective assembly holes to secure said radiator to said strengthening member.

3. The electrical connector according to claim 1, wherein the top of the sidewall bends inwardly to form the pressing region for pressing the chip module.

4. The electrical connector according to claim 1, wherein the sidewall has the structure of a frame.

5. The electrical connector according to claim 1, wherein the sidewall includes at least two independent parts which are connected together from the location member and extend outwardly from the sidewall and form a structure with the shape of a plate.

6. The electrical connector according to claim 1, wherein the positioning holes are disposed symmetrically on the location member.

7. The electrical connector according to claim 1, wherein the positioning holes comprise a plurality of fixing holes and assembly holes, which are disposed symmetrically on the location member.

8. The electrical connector according to claim 1, wherein the locking members are screws.

9. The electrical connector according to claim 5, wherein the sidewall comprises four independent parts, which are disposed symmetrically.

10. The electrical connector according to claim 9, wherein the top of the sidewall bends to the inside and forms a pressing region with the shape of a wedge in order to press down the chip module.

* * * * *